US009429385B1

(12) United States Patent
Allen et al.

(10) Patent No.: US 9,429,385 B1
(45) Date of Patent: Aug. 30, 2016

(54) DRUM MAGAZINE FOR LOADING PAINTBALLS AND SHAPED PROJECTILES INTO A MAGAZINE-FED FIREARM

(71) Applicants: Scott William Allen, San Antonio, TX (US); Pascal Deleporte, Faches Thumesnil (FR); Jerome Charles Bernard Jean Klein, Ars sur Moselle (FR)

(72) Inventors: Scott William Allen, San Antonio, TX (US); Pascal Deleporte, Faches Thumesnil (FR); Jerome Charles Bernard Jean Klein, Ars sur Moselle (FR)

( * ) Notice: Subject to any disclaimer, the term of this patent is extended or adjusted under 35 U.S.C. 154(b) by 0 days.

(21) Appl. No.: 14/991,715

(22) Filed: Jan. 8, 2016

Related U.S. Application Data

(60) Provisional application No. 62/114,736, filed on Feb. 11, 2015.

(51) Int. Cl.
*F41B 11/54* (2013.01)

(52) U.S. Cl.
CPC ..... *F41B 11/54* (2013.01)

(58) Field of Classification Search
CPC ..... F41B 11/55; F41B 11/54; F41B 11/50; F41B 11/89; F41A 9/65; F41A 9/67; F41A 9/03; Y10T 74/1598; Y10T 74/18232
See application file for complete search history.

(56) References Cited

U.S. PATENT DOCUMENTS 2,338,984 A * 1/1944 Van Horn ..... F41A 9/73 42/50
4,332,097 A * 6/1982 Taylor, Jr. ..... F41A 9/73 42/50
4,413,546 A * 11/1983 Taylor, Jr. ..... F41A 9/73 89/33.02
4,487,103 A * 12/1984 Atchisson ..... F41A 9/73 89/33.02
4,926,742 A * 5/1990 Ma ..... F41A 9/75 42/49.01
4,986,251 A * 1/1991 Lilley ..... F41B 11/55 124/48
6,470,871 B2 * 10/2002 Casas-Salva ..... F41B 11/54 124/48
6,745,755 B2 * 6/2004 Piccini ..... F41A 9/28 124/49
6,837,844 B1 * 1/2005 Ellard ..... A61N 5/1007 600/7
2003/0127085 A1 * 7/2003 Brunette ..... F41B 11/55 124/74
2006/0042613 A1 * 3/2006 Hu ..... F41B 11/54 124/48
2011/0041823 A1 * 2/2011 Victor ..... F41A 9/73 124/48
2011/0078937 A1 * 4/2011 Rich ..... F41A 9/73 42/49.01

* cited by examiner

*Primary Examiner* — Melba Bumgarner
*Assistant Examiner* — Amir Klayman

(57) ABSTRACT

A drum magazine for loading paintballs and shaped projectiles into a magazine-fed firearm includes a spiral feed track that stores paintballs as well as a projectile feed assembly that pushes paintballs through the spiral feed track. Paintballs exit the spiral feed track through a feed port and through a modular feed adapter that is inserted into a paintball marker. A clock spring and a spring rotor are utilized in order to adjust the pressure that is exerted on paintballs within the spiral feed track. Tension in the clock spring may be increased to a desired level by rotating the spring rotor to wind the clock spring. Paintballs are prevented from loading when the drum magazine is not loaded into a paintball marker by a locking assembly. A ratcheting gear engages a gear locking pawl while the drum magazine is not loaded, preventing the clock spring from becoming unwound.

12 Claims, 8 Drawing Sheets

SECTION A-A

SECTION B-B

SECTION C-C

SECTION D-D

DRUM MAGAZINE FOR LOADING PAINTBALLS AND SHAPED PROJECTILES INTO A MAGAZINE-FED FIREARM

The current application claims a priority to the U.S. Provisional Patent application Ser. No. 62/114,736 filed on Feb. 11, 2015.

FIELD OF THE INVENTION

The present invention relates generally to a magazine for paintballs and similar projectiles. More specifically, the present invention is a drum magazine for loading paintballs and shaped projectiles into a magazine-fed firearm.

BACKGROUND OF THE INVENTION

In the sport of paintball, firearms specially designed for paintball (referred to as "markers") are loaded with spherical gelatin capsules containing water-soluble "paint". These paintballs are most often loaded into a paintball marker through a hopper that is mounted to the paintball marker and is able to feed paintballs into the marker chamber. Hoppers are often capable of feeding paintballs very quickly in order to accommodate the very high rates of fire that many paintball markers are capable of. However, a common alternative to competitive speedball and more casual recreational play is "mag fed" gameplay. Participants in mag fed gameplay utilize paintball markers that greatly resemble conventional firearms and take part in scenarios that are more realistic and tactical than other types of paintball gameplay. The paintball markers utilized in mag fed paintball play are often designed to resemble conventional firearms as closely as possible and as such, paintballs are generally loaded into the markers via magazines in lieu of hoppers. In addition to the more realistic and tactical nature of mag fed gameplay, the limited ammunition capacity of the magazines presents an additional challenge and layer of realism to mag fed gameplay. Magazines designed for paintballs often resemble conventional magazines and may include variants such as the STANAG box magazine and various types of drum magazines. Drum magazines are often favored due to their comparatively higher ammunition capacity relative to box magazines, lowering the frequency of reloads.

The present invention is a drum magazine for loading paintballs and shaped projectiles into a magazine-fed firearm. The present invention stores paintballs in a spiral arrangement and is able to feed the paintballs into a magazine-fed paintball marker. The present invention includes an adjustable internal feeding mechanism that allows the present invention to be utilized with a wide variety of paintballs ranging from very soft paintballs to very brittle paintballs by adjusting the pressure that is exerted on the paintballs within the present invention. The present invention is additionally locked when the present invention is not loaded into a firearm, preventing paintballs from feeding while the magazine is not loaded into the firearm.

DETAIL DESCRIPTIONS OF THE INVENTION

All illustrations of the drawings are for the purpose of describing selected versions of the present invention and are not intended to limit the scope of the present invention.

Figure 1:
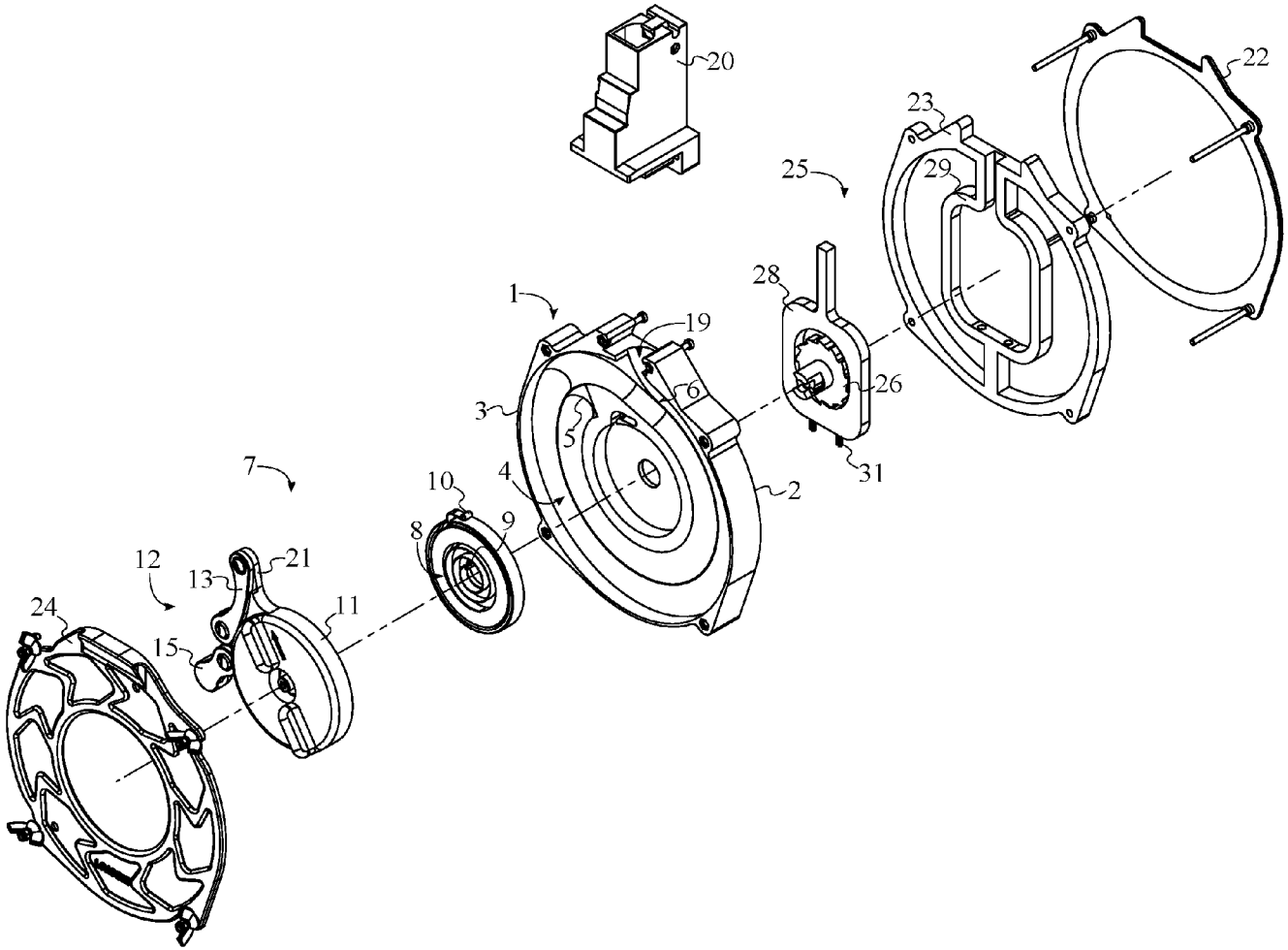
FIG. 1 is an exploded rear perspective view of the present invention.
Figure 2:
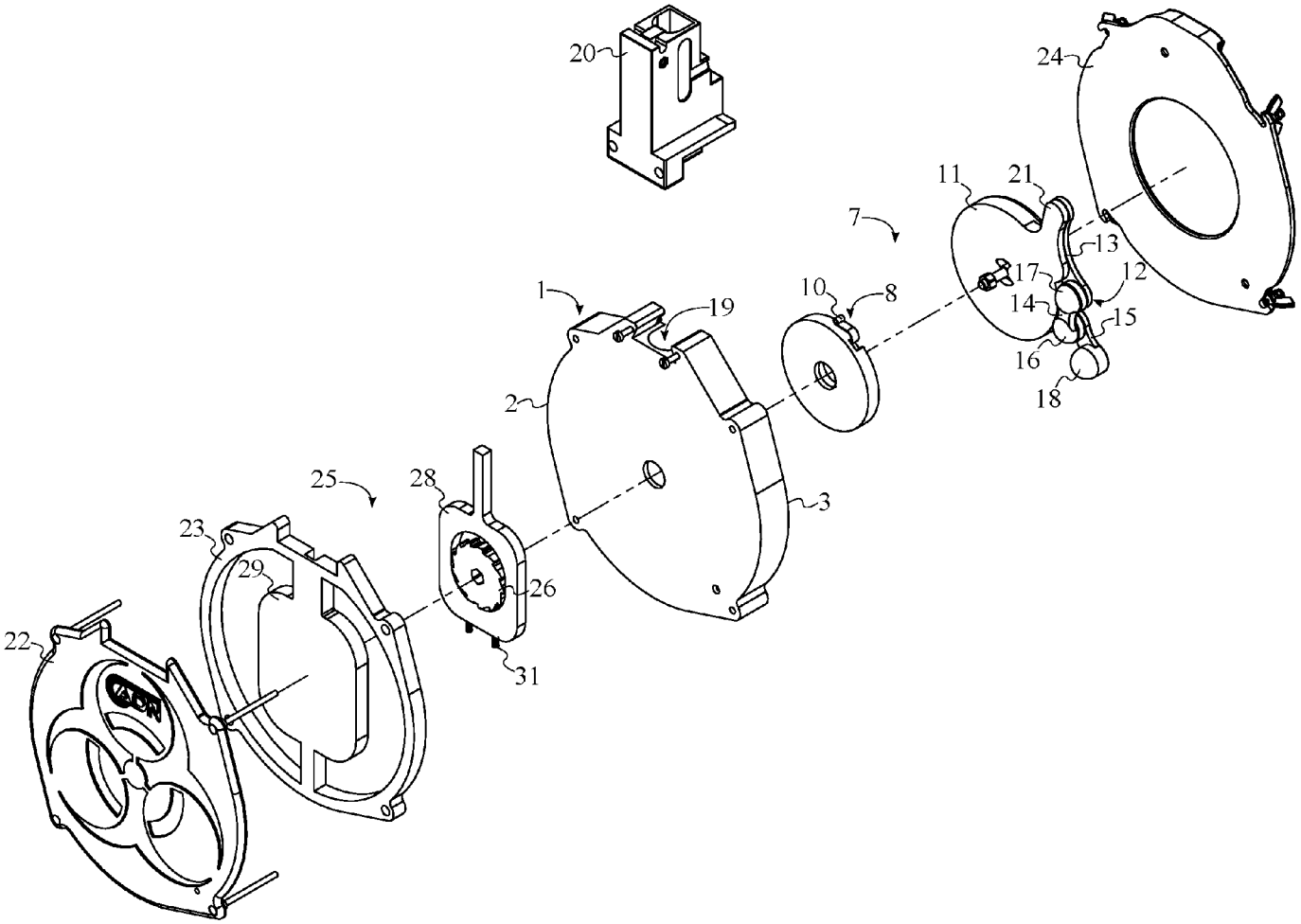
FIG. 2 is an exploded front perspective view of the present invention.

The present invention is a drum magazine for loading paintballs and shaped projectiles into a magazine-fed firearm. The present invention is shown in FIG. 1 and FIG. 2 and comprises a housing platform 1, a spiral feed track 4, a projectile feed assembly 7, a feed port 19, a modular feed adapter 20, and a rotor protrusion 21. Interior arrangement of components is shown in FIGS. 3-6.

Figure 5:
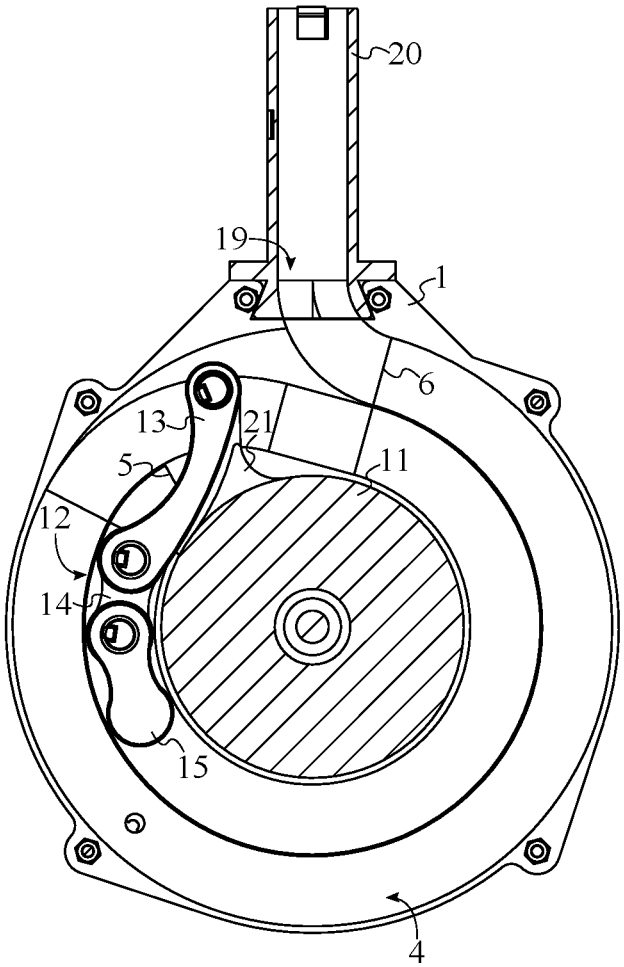
FIG. 5 is a cross-sectional view of the present invention taken along line B-B of FIG. 3.
Figure 6:
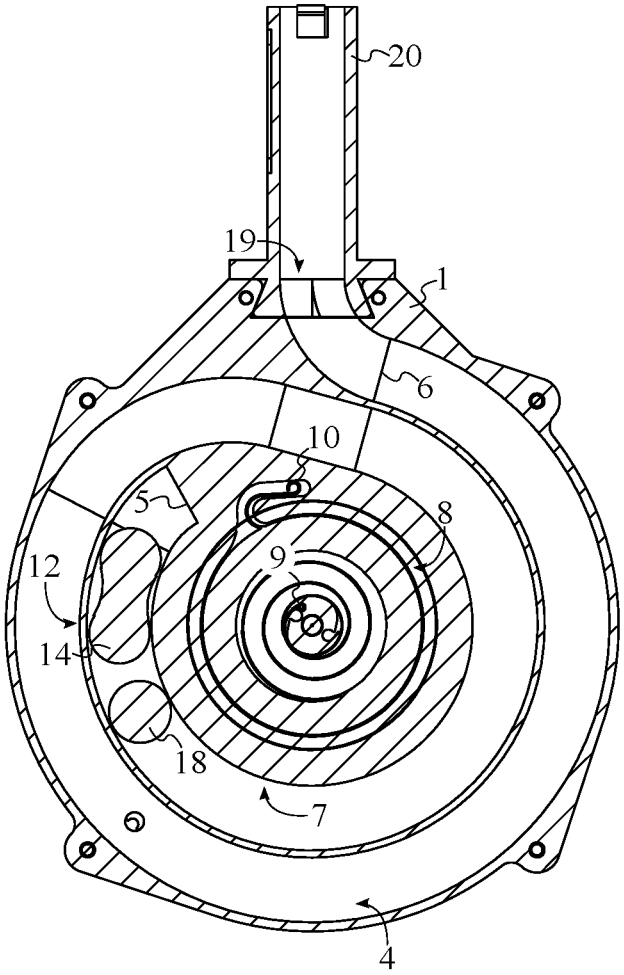
FIG. 6 is a cross-sectional view of the present invention taken along line C-C of FIG. 3.

The housing platform 1 is the main body to which all other components of the present invention are attached. As shown in FIG. 5 and FIG. 6, the spiral feed track 4 is a pathway that holds paintballs in place in a spiral arrangement within the present invention. The paintballs are able to travel along and exit the spiral feed track 4 as the paintball marker to which the present invention is attached is discharged. The spiral feed track 4 is integrated onto the housing platform 1, allowing paintballs to be placed directly into the spiral feed track 4 when loading the present invention.

With reference to FIG. 1, FIG. 2, FIG. 5, and FIG. 6, the projectile feed assembly 7 enables paintballs to be pushed along the spiral feed track 4 and exit the present invention as the paintball marker is discharged. The projectile feed assembly 7 comprises a clock spring 8, a spring rotor 11, and radius-adjusting pusher arm 12. In the preferred embodiment of the present invention, the clock spring 8 is a flat helical spring that may be wound in order to increase the pressure exerted on the paintballs within the spiral feed track 4 by the projectile feed assembly 7. The clock spring 8 is wound to a desired degree of pressure exerted on the paintballs. A higher pressure may be more desirable for more brittle paintballs while a lower pressure may be desirable for softer paintballs. The spring rotor 11 is a circular plate with extrusions that may be grasped by the user. The spring rotor 11 is rotated in order to increase the tension in the clock spring 8, correspondingly increasing the pressure exerted on the paintballs by the projectile feed assembly 7. The spring rotor 11 may be rotated manually, allowing the user to adjust the pressure exerted on the paintballs without the use of tools. An inner end 9 of the clock spring 8 is positioned adjacent to a closed central end 5 of the spiral feed track 4. This positions the inner end 9 in a manner such that the inner end 9 may be connected to the spring rotor 11, allowing the spring rotor 11 to increase the tension in the clock spring 8. The spring rotor 11 is axially connected to the inner end 9, allowing the spring rotor 11 to be rotated in order to increase the tension in the clock spring 8. An outer end 10 of the clock spring 8 is fixed to the housing platform 1, anchoring the clock spring 8 to the housing platform 1 and preventing the clock spring 8 from becoming dislodged while being wound.

Again with reference to FIG. 5, the radius-adjusting pusher arm 12 is a rotatable component that is able to push the paintballs within the present invention along the spiral feed track 4 as the paintball marker is discharged. The rotor protrusion 21 enables the radius-adjusting pusher arm 12 to be connected to the spring rotor 11. The rotor protrusion 21 is peripherally connected to the spring rotor 11, enabling the radius-adjusting pusher arm 12 to rotate along with the spring rotor 11. The radius-adjusting pusher arm 12 is pivotally and peripherally linked to the rotor protrusion 21, allowing the radius-adjusting pusher arm 12 to rotate along with the spring rotor 11 as tension in the clock spring 8 is released as the paintball marker is discharged. The radius-adjusting pusher arm 12 is slidably engaged into the spiral feed track 4, enabling the radius-adjusting pusher arm 12 to drive paintballs along the spiral feed track 4 as the spring rotor 11 rotates.

With further reference to FIG. 1, FIG. 2, FIG. 5, and FIG. 6, the feed port 19 is an opening that serves as an exit for paintballs within the spiral feed track 4. The feed port 19 is in fluid communication with a peripheral end 6 of the spiral feed track 4. As such, paintballs that are pushed along the spiral feed track 4 by the radius-adjusting pusher arm 12 are able to exit the spiral feed track 4 via the feed port 19. The modular feed adapter 20 allows the present invention to be loaded into a paintball marker or similar firearm. The modular feed adapter 20 may vary in terms of specific design in order to allow the present invention to be utilized in conjunction with a variety of firearms. The modular feed adapter 20 is removably mounted to the housing platform 1, adjacent to the feed port 19. Paintballs are thus directed through the spiral feed track 4, the feed port 19, and the modular feed adapter 20 before being loaded into the paintball marker. The modular feed adapter 20 may be easily swapped in order to enable the present invention to be loaded into multiple types of firearms.

Figure 3:
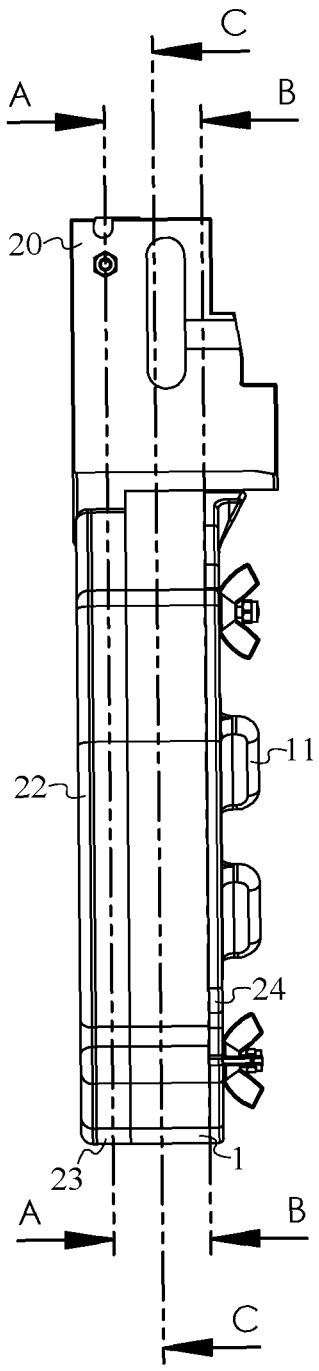
FIG. 3 is a side view of the present invention.
Figure 4:
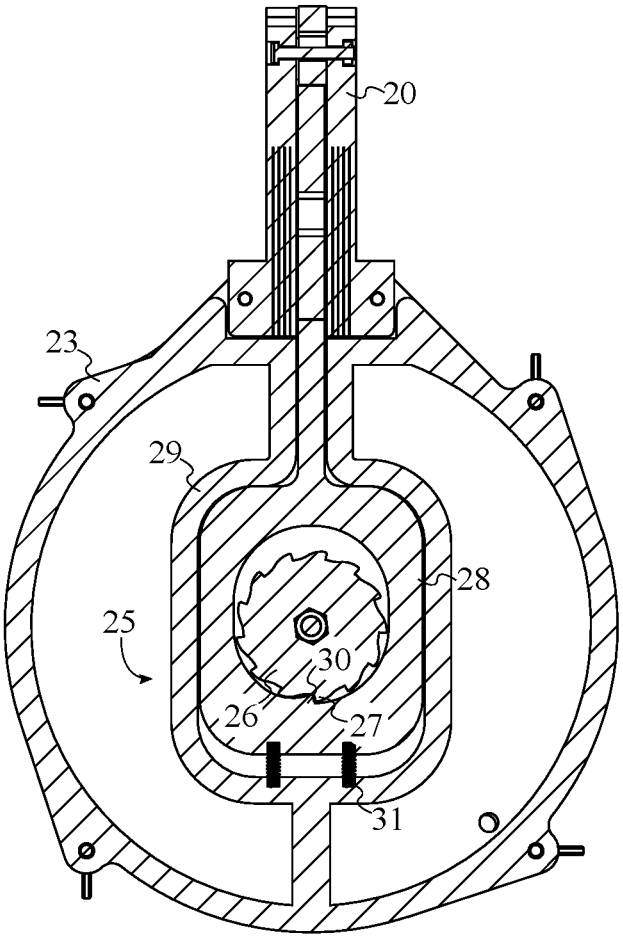
FIG. 4 is a cross-sectional view of the present invention taken along line A-A of FIG. 3.

As shown in FIGS. 1-3, the present invention further comprises a front plate 22, a spacer plate 23, and a rear plate 24. The front plate 22 and the rear plate 24 cover and protect the internal components of the present invention while the spacer plate 23 provides clearance between the front plate 22 and the internal components. The housing platform 1 comprises a front side 2 and a rear side 3 that are opposing surfaces of the housing platform 1. The rear plate 24 is removably mounted to the rear side 3 and is able to cover and protect paintballs within the spiral feed track 4 and the projectile feed assembly 7. In the preferred embodiment of the present invention, the rear plate 24 is removed from the housing platform 1 in order to fill the spiral feed track 4 with paintballs. Additionally, the rear plate 24 may be transparent in order to allow the user to visually ascertain the amount of ammunition remaining within the present invention. The spacer plate 23 is removably mounted to the front side 2 and offsets the front plate 22 from the housing platform 1. The front plate 22 is removably mounted to the spacer plate 23, covering additional internal components of the present invention. The spacer plate 23 and the front plate 22 are removable in order to access the internal components. In the preferred embodiment of the present invention, the front plate 22, the spacer plate 23, and the rear plate 24 are attached to the present invention via fasteners such as, but not limited to, screws. In the preferred embodiment of the present invention, the rear plate 24 is removable from the present invention without the use of tools.

Again with reference to FIG. 1, FIG. 2, and FIGS. 4-6, the present invention further comprises a locking assembly 25 that is utilized to prevent the clock spring 8 from becoming unwound and causing the projectile feed assembly 7 to push paintballs through the spiral feed track 4 when the present invention is not loaded into a paintball marker. The locking assembly 25 comprises a ratcheting gear 26 that enables the spring rotor 11 to be rotated in a single direction when increasing the tension in the clock spring 8. When the present invention is not loaded into a paintball marker, the ratcheting gear 26 prevents the spring rotor 11 from rotating in the opposite direction, causing the projectile feed assembly 7 to push paintballs through the spiral feed track 4. The ratcheting gear 26 is positioned opposite to the clock spring 8 through the housing platform 1 and is axially connected to the spring rotor 11. This enables the ratcheting gear 26 to rotate in a single direction as the spring rotor 11 is rotated when increasing the tension in the clock spring 8.

Figure 7:
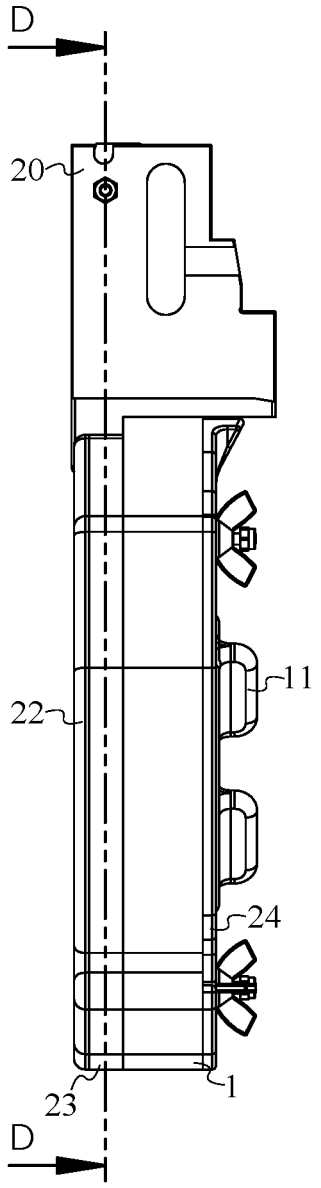
FIG. 7 is a side view of the present invention.
Figure 8:
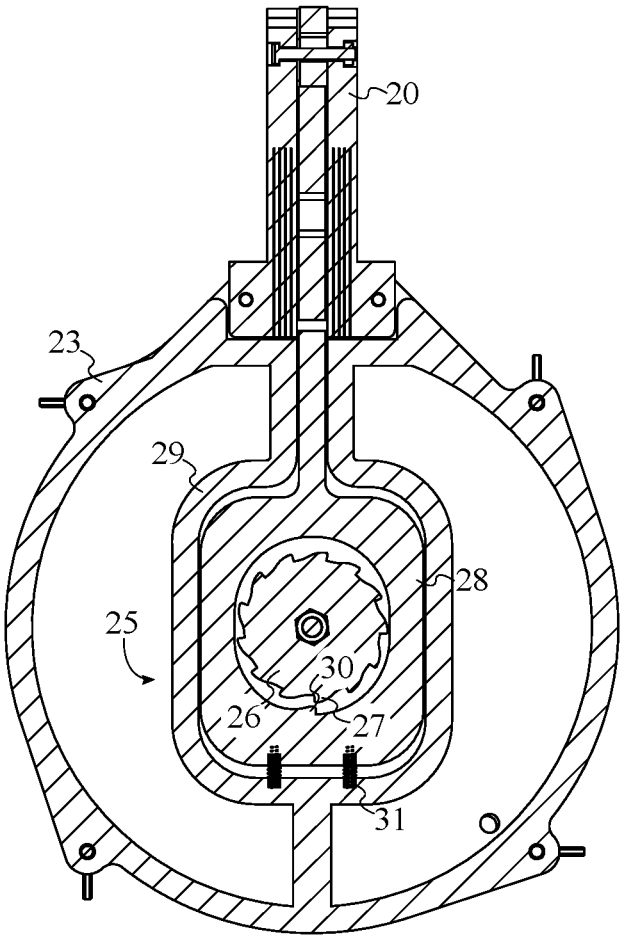
FIG. 8 is a cross-sectional view of the present invention taken along line D-D of FIG. 7.

The locking assembly 25 further comprises a gear locking plate 28, a gear locking bracket 29, and a gear locking pawl 30. The gear locking plate 28 is a plate within which the ratcheting gear 26 is able to freely rotate in one direction as the spring rotor 11 is rotated and the tension in the clock spring 8 is increased. The ratcheting gear 26 is seated within the gear locking plate 28 and is able to rotate within the gear locking plate 28. The gear locking bracket 29 is an enclosing bracket for the gear locking plate 28. The gear locking bracket 29 is positioned centrally on the spacer plate 23, positioning the gear locking bracket 29, the gear locking plate 28, and the ratcheting gear 26 in between the housing platform 1 and the front plate 22. The gear locking plate 28 is slidably engaged into the modular feed adapter 20 and the gear locking bracket 29. This enables the gear locking plate 28 to slide within the gear locking bracket 29 when the present invention is loaded into a paintball marker. The gear locking pawl 30 holds the ratcheting gear 26 in place and prevents rotation while the present invention is not loaded into a paintball marker. However, when the present invention is loaded into a paintball marker, the gear locking plate 28 slides within the gear locking bracket 29 and the ratcheting gear 26 is freed from the gear locking pawl 30. The clock spring 8 is thus allowed to unwind and the projectile feed assembly 7 begins moving paintballs through the spiral feed track 4. The gear locking pawl 30 is positioned within the gear locking plate 28, enabling the gear locking pawl 30 to engage the ratcheting gear 26 when the present invention is not loaded into a paintball marker. A selected tooth 27 from the ratcheting gear 26 is removably engaged to the gear locking pawl 30, preventing the clock spring 8 from being unwound while the present invention is not loaded into a paintball marker. As shown in FIG. 7 and FIG. 8, the selected tooth 27 is released from the gear locking pawl 30 when the gear locking plate 28 slides within the gear locking bracket 29 as the present invention is loaded into a paintball marker.

With continued reference to FIG. 1, FIG. 2, and FIGS. 4-6, the present invention further comprises at least one buffer spring 31. The at least one buffer spring 31 enables the gear locking plate 28 to slide within the gear locking bracket 29 and free the ratcheting gear 26 from the gear locking pawl 30 when the present invention is loaded into a paintball marker. The at least one buffer spring 31 additionally returns the gear locking plate 28 to the original position when the present invention is removed from a paintball marker, locking the ratcheting gear 26 against the gear locking pawl 30. The at least one buffer spring 31 is positioned in between the gear locking plate 28 and the gear locking bracket 29. This enables the gear locking plate 28 to press against the at least one buffer spring 31 as the gear locking plate 28 slides within the gear locking bracket 29 as the present invention is loaded into a paintball marker. When the present invention is removed from a paintball marker, the at least one buffer spring 31 is able to return the gear locking plate 28 the original position within the gear locking bracket 29.

With reference to FIG. 1, FIG. 2, and FIG. 5, the radius-adjusting pusher arm 12 comprises a linkage arm 13, a stabilizing arm 14, an extension arm 15, a forward nub 16, a reverse nub 17, and a single nub 18. The linkage arm 13 is the portion of the radius-adjusting pusher arm 12 that is joined to the spring rotor 11 in order to allow the radius-adjusting pusher arm 12 to rotate along with the spring rotor 11. The linkage arm 13 is pivotally and peripherally connected to the rotor protrusion 21, enabling the linkage arm 13 to rotate with respect to the rotor protrusion 21. The stabilizing arm 14 joins the linkage arm 13 to the extension arm 15 and ensures that the radius-adjusting pusher arm 12 stays engaged into the spiral feed track 4. The stabilizing arm 14 is pivotally and adjacently connected to the linkage arm 13, opposite to the rotor protrusion 21. This allows the stabilizing arm 14 to rotate with respect to the linkage arm 13. The extension arm 15 enables the radius-adjusting pusher arm 12 to push paintballs along the wider radius portions of the spiral feed track 4. The extension arm 15 is pivotally and adjacently connected to the stabilizing arm 14, opposite to the linkage arm 13. The extension arm 15 is thus able to pivot with respect to the stabilizing arm 14.

The rear plate 24 is removed to allow the tension to be adjusted. This is accomplished by removing the linkage arm 13, the stabilizing arm 14, and the extension arm 15 from the rotor protrusion 21. The spring rotor 11 is then rotated freely in order to adjust the tension of the clock spring 8. The linkage arm 13, the stabilizing arm 14, and the extension arm 15 are then reattached to the rotor protrusion 21. By removing the linkage arm 13, the stabilizing arm 14, and the extension arm 15 prior to winding the clock spring 8, the user is able to store a greater amount of tension in the clock spring 8. This enables the user to adjust the tension in the clock spring 8 as desired for different types of soft and brittle paintballs.

The forward nub 16, the reverse nub 17, and the single nub 18 ensure that the radius-adjusting pusher arm 12 stays engaged into the spiral feed track 4 as paintballs are fed into a paintball marker. The forward nub 16 and the reverse nub 17 are connected adjacent to the stabilizing arm 14. The forward nub 16 and the reverse nub 17 thus ensure that the stabilizing arm 14 remains engaged into the spiral feed track 4. The forward nub 16 and the reverse nub 17 are positioned opposite to each other along the stabilizing arm 14, ensuring that the stabilizing arm 14 stays engaged into the spiral feed track 4 at two positions on the stabilizing arm 14. This is particularly important as the stabilizing arm 14 serves to connect the linkage arm 13 to the extension arm 15. The single nub 18 is connected adjacent to the extension arm 15, opposite to the stabilizing arm 14. This ensures that the extension arm 15 to remain engaged into the spiral feed track 4 while still being able to rotate with respect to the stabilizing arm 14. The forward nub 16, the reverse nub 17, and the single nub 18 are sequentially engaged into the spiral feed track 4, ensuring that the entirety of the radius-adjusting pusher arm 12 remains engaged into the spiral feed track 4 as paintballs are fed into a paintball marker.

The present invention may be utilized with various types of paintball markers. While the present invention is primarily intended for use with rifle and carbine-style magazine-fed paintball markers, the physical design of the present invention may vary in order to allow the present invention to be utilized with other types of paintball markers, such as handguns. However, it is important to note that the spiral feed track 4, the projectile feed assembly 7, and the locking assembly 25 remain consistent throughout all embodiments of the present invention.

Although the present invention has been explained in relation to its preferred embodiment, it is understood that many other possible modifications and variations can be made without departing from the spirit and scope of the present invention as hereinafter claimed.

What is claimed is:

1. A drum magazine for loading paintballs and shaped projectiles into a magazine-fed firearm comprises:
- a housing platform;
- a spiral feed track;
- a projectile feed assembly;
- a feed port;
- a modular feed adapter;
- a rotor protrusion;
- the projectile feed assembly comprises a clock spring, a spring rotor, and a radius-adjusting pusher arm;
- the spiral feed track being integrated onto the housing platform;
- an inner end of the clock spring being positioned adjacent to a closed central end of the spiral feed track;
- an outer end of the clock spring being fixed to the housing platform;
- the spring rotor being axially connected to the inner end;
- the radius-adjusting pusher arm being slidably engaged into the spiral feed track;
- the feed port being in fluid communication with a peripheral end of the spiral feed track;
- the modular feed adapter being removably mounted to the housing platform, adjacent to the feed port;
- the rotor protrusion being peripherally connected to the spring rotor;
- the radius-adjusting pusher arm being pivotally and peripherally linked to the rotor protrusion;
- a front plate;
- a spacer plate;
- a rear plate;
- the housing platform comprises a front side and a rear side;
- the rear plate being removably mounted to the rear side;
- the spacer plate being removably mounted to the front side; and
- the front plate being removably mounted to the spacer plate.

2. The drum magazine for loading paintballs and shaped projectiles into a magazine-fed firearm as claimed in claim 1 further comprises:
- a locking assembly;
- the locking assembly comprises a ratcheting gear;
- the ratcheting gear being positioned opposite to the clock spring through the housing platform; and
- the ratcheting gear being axially connected to the spring rotor.

3. The drum magazine for loading paintballs and shaped projectiles into a magazine-fed firearm as claimed in claim 1 further comprises:
- a spacer plate;
- a locking assembly;
- the locking assembly comprises a ratcheting gear, a gear locking plate, a gear locking bracket, and a gear locking pawl;
- the gear locking bracket being positioned centrally on the spacer plate;
- the gear locking plate being slidably engaged into the modular feed adapter;

the ratcheting gear being seated within the gear locking plate;

the gear locking plate being slidably engaged into the gear locking bracket;

the gear locking pawl being positioned within the gear locking plate; and a selected tooth from the ratcheting gear being removably engaged to the gear locking pawl.

4. The drum magazine for loading paintballs and shaped particles into a magazine-fed firearm as claimed in claim 3 further comprises:

at least one buffer spring; and the at least one buffer spring being positioned in between the gear locking plate and the gear locking bracket.

5. The drum magazine for loading paintballs and shaped projectiles into a magazine-fed firearm as claimed in claim 1 further comprises:

the radius-adjusting pusher arm comprises a linkage arm, a stabilizing arm, an extension arm, a forward nub, a reverse nub, and a single nub;

the linkage arm being pivotally and peripherally connected to the rotor protrusion;

the stabilizing arm being pivotally and adjacently connected to the linkage arm, opposite to the rotor protrusion;

the forward nub and the reverse nub being connected adjacent to the stabilizing arm;

the forward nub and the reverse nub being positioned opposite to each other along the stabilizing arm;

the extension arm being pivotally and adjacently connected to the stabilizing arm, opposite to the linkage arm;

the single nub being connected adjacent to the extension arm, opposite to the stabilizing arm; and the forward nub, the reverse nub, and the single nub being sequentially engaged into the spiral feed track.

6. A drum magazine for loading paintballs and shaped projectiles into a magazine-fed firearm comprises:

a housing platform;

a spiral feed track;

a projectile feed assembly;

a feed port;

a modular feed adapter;

a rotor protrusion;

the projectile feed assembly comprises a clock spring, a spring rotor, and a radius-adjusting pusher arm;

the radius-adjusting pusher arm comprises a linkage arm, a stabilizing arm, an extension arm, a forward nub, a reverse nub, and a single nub;

the spiral feed track being integrated onto the housing platform;

an inner end of the clock spring being positioned adjacent to a closed central end of the spiral feed track;

an outer end of the clock spring being fixed to the housing platform;

the spring rotor being axially connected to the inner end;

the radius-adjusting pusher arm being slidably engaged into the spiral feed track;

the feed port being in fluid communication with a peripheral end of the spiral feed track;

the modular feed adapter being removably mounted to the housing platform, adjacent to the feed port;

the rotor protrusion being peripherally connected to the spring rotor;

the radius-adjusting pusher arm being pivotally and peripherally linked to the rotor protrusion;

the linkage arm being pivotally and peripherally connected to the rotor protrusion;

the stabilizing arm being pivotally and adjacently connected to the linkage arm, opposite to the rotor protrusion;

the forward nub and the reverse nub being connected adjacent to the stabilizing arm;

the forward nub and the reverse nub being positioned opposite to each other along the stabilizing arm;

the extension arm being pivotally and adjacently connected to the stabilizing arm, opposite to the linkage arm;

the single nub being connected adjacent to the extension arm, opposite to the stabilizing arm;

the forward nub, the reverse nub, and the single nub being sequentially engaged into the spiral feed track;

at least one buffer spring; and the at least one buffer spring being positioned in between the gear locking plate and the gear locking bracket.

7. The drum magazine for loading paintballs and shaped projectiles into a magazine-fed firearm as claimed in claim 6 further comprises:

a front plate;

a spacer plate;

a rear plate;

the housing platform comprises a front side and a rear side;

the rear plate being removably mounted to the rear side;

the spacer plate being removably mounted to the front side; and the front plate being removably mounted to the spacer plate.

8. The drum magazine for loading paintballs and shaped projectiles into a magazine-fed firearm as claimed in claim 6 further comprises:

a locking assembly;

the locking assembly comprises a ratcheting gear;

the ratcheting gear being positioned opposite to the clock spring through the housing platform; and the ratcheting gear being axially connected to the spring rotor.

9. The drum magazine for loading paintballs and shaped projectiles into a magazine-fed firearm as claimed in claim 6 further comprises:

a spacer plate;

a locking assembly;

the locking assembly comprises a ratcheting gear, a gear locking plate, a gear locking bracket, and a gear locking pawl;

the gear locking bracket being positioned centrally on the spacer plate;

the gear locking plate being slidably engaged into the modular feed adapter;

the ratcheting gear being seated within the gear locking plate;

the gear locking plate being slidably engaged into the gear locking bracket;

the gear locking pawl being positioned within the gear locking plate; and a selected tooth from the ratcheting gear being removably engaged to the gear locking pawl.

10. A drum magazine for loading paintballs and shaped projectiles into a magazine-fed firearm comprises:

a housing platform;

a spiral feed track;

a projectile feed assembly;

a feed port;

a modular feed adapter;
a rotor protrusion;
a spacer plate;
a locking assembly;
the projectile feed assembly comprises a clock spring, a spring rotor, and a radius-adjusting pusher arm;
the radius-adjusting pusher arm comprises a linkage arm, a stabilizing arm, an extension arm, a forward nub, a reverse nub, and a single nub;
the locking assembly comprises a ratcheting gear, a gear locking plate, a gear locking bracket, and a gear locking pawl;
the spiral feed track being integrated onto the housing platform;
an inner end of the clock spring being positioned adjacent to a closed central end of the spiral feed track;
an outer end of the clock spring being fixed to the housing platform;
the spring rotor being axially connected to the inner end;
the radius-adjusting pusher arm being slidably engaged into the spiral feed track;
the feed port being in fluid communication with a peripheral end of the spiral feed track;
the modular feed adapter being removably mounted to the housing platform, adjacent to the feed port;
the rotor protrusion being peripherally connected to the spring rotor;
the radius-adjusting pusher arm being pivotally and peripherally linked to the rotor protrusion;
the linkage arm being pivotally and peripherally connected to the rotor protrusion;
the stabilizing arm being pivotally and adjacently connected to the linkage arm, opposite to the rotor protrusion;
the forward nub and the reverse nub being connected adjacent to the stabilizing arm;
the forward nub and the reverse nub being positioned opposite to each other along the stabilizing arm;
the extension arm being pivotally and adjacently connected to the stabilizing arm, opposite to the linkage arm;
the single nub being connected adjacent to the extension arm, opposite to the stabilizing arm;
the forward nub, the reverse nub, and the single nub being sequentially engaged into the spiral feed track;
the gear locking bracket being positioned centrally on the spacer plate;
the gear locking plate being slidably engaged into the modular feed adapter;
the ratcheting gear being seated within the gear locking plate;
the gear locking plate being slidably engaged into the gear locking bracket;
the gear locking pawl being positioned within the gear locking plate;
a selected tooth from the ratcheting gear being removably engaged to the gear locking pawl;
at least one buffer spring; and
the at least one buffer spring being positioned in between the gear locking plate and the gear locking bracket.

11. The drum magazine for loading paintballs and shaped projectiles into a magazine-fed firearm as claimed in claim 10 further comprises:
a front plate;
a spacer plate;
a rear plate;
the housing platform comprises a front side and a rear side;
the rear plate being removably mounted to the rear side;
the spacer plate being removably mounted to the front side; and
the front plate being removably mounted to the spacer plate.

12. The drum magazine for loading paintballs and shaped projectiles into a magazine-fed firearm as claimed in claim 10 further comprises:
a locking assembly;
the locking assembly comprises a ratcheting gear;
the ratcheting gear being positioned opposite to the clock spring through the housing platform; and
the ratcheting gear being axially connected to the spring rotor.

* * * * *